US005728988A

United States Patent [19]

Meinherz et al.

[11] Patent Number: 5,728,988

[45] Date of Patent: Mar. 17, 1998

[54] HIGH-VOLTAGE POWER SWITCH WITH A FIELD ELECTRODE

[75] Inventors: Manfred Meinherz; Günther Gilmozzi; Edelhard Kynast; Lutz-Rüdiger Jänicke, all of Berlin, Germany

[73] Assignee: Siemens Aktiengesellschaft, München, Germany

[21] Appl. No.: 663,244

[22] PCT Filed: Dec. 7, 1994

[86] PCT No.: PCT/DE94/01501

§ 371 Date: Sep. 24, 1996

§ 102(e) Date: Sep. 24, 1996

[87] PCT Pub. No.: WO95/17001

PCT Pub. Date: Jun. 22, 1995

[30] Foreign Application Priority Data

Dec. 17, 1993 [DE] Germany ..... 43 43 786.9

[51] Int. Cl.[6] ..... H01H 33/88

[52] U.S. Cl. ..... 218/65

[58] Field of Search ..... 218/65, 61, 62; 200/12

[56] References Cited

U.S. PATENT DOCUMENTS

| | | | |
|---|---|---|---|
| 3,739,124 | 6/1973 | Richter et al. | 200/148 A |
| 4,149,054 | 4/1979 | Kopplin | 200/318 |
| 4,445,014 | 4/1984 | Gruner et al. | 200/78 |
| 5,285,036 | 2/1994 | Lorenz | 200/148 A |
| 5,563,389 | 10/1996 | Marin et al. | 218/62 |

*Primary Examiner*—Edward Tso
*Attorney, Agent, or Firm*—Kenyon & Kenyon

[57] ABSTRACT

High-voltage power switch including a first and a second contact piece that form an air gap in the switched-off state, a compression piston that surrounds the first contact piece, a drivable compression cylinder that surrounds the second contact piece in the switched-on state, and a first field electrode that surrounds the second contact piece in the switched-off state and is axially movable in relation thereto. The high-voltage power switch also provides that the first field electrode is insulated from the compression cylinder and axially movable in relation thereto and the compression cylinder is displaced by a distance from the second contact piece in the switched-off state.

3 Claims, 1 Drawing Sheet

HIGH-VOLTAGE POWER SWITCH WITH A FIELD ELECTRODE

FIELD OF THE INVENTION

The present invention relates to a high-voltage power switch.

BACKGROUND INFORMATION

A conventional high-voltage power switch is described in German Application No. 21 40 284. In this power switch, a field electrode is embedded in the compression cylinder. Due to the fact that the compression cylinder extends into the gap in a switched-off position, the gap is exposed to a high dielectric load through this field electrode.

In another conventional high-voltage power switch described in German Application No. 42 17 232, a first field electrode is formed by a bottom of the movable compression cylinder. In the switched-off state, the compression cylinder bridges the gap, so that the compression cylinder bottom (configured as a field electrode) coaxially surrounds one of the contact pieces in a switched-off state, while the fixed compression piston surrounds the other contact piece.

It is disadvantageous, especially in the case of very high voltages, to have the gap bridged by one insulating solid body, as in the case of known devices.

SUMMARY OF THE INVENTION

An object of the present invention is to provide a high-voltage power switch, wherein, on the one hand, field electrodes are provided around the gap area to make the electric field more uniform and, on the other hand, the gap has the highest possible dielectric strength in the switched-off state.

This object is achieved according to the present invention by configuring the compression piston as a second field electrode and the compression piston is drivable in the direction of the second contact piece.

A high-voltage power switch according to the present invention includes first and second contact pieces that delimit an air gap in the switched-off state, a compression piston that surrounds the first contact piece, a drivable compression cylinder that surrounds the second contact piece in the switched-on state, and a first field electrode that surrounds the second contact piece in the switched-off state and is axially movable in relation thereto. The first field electrode is separate from the compression cylinder and axially movable in relation thereto. The compression cylinder is positioned at a predefined distance from the second contact piece in the switched-off state. In addition, the first field electrode is spring-loaded axially in the direction of the compression cylinder, with a stop being provided which limits the motion of the first field electrode toward the gap.

By separating the first field electrode from the compression cylinder, the latter can be removed from the second contact piece during switch-off so that it does not bridge the gap in the switched-off position. Starting at the time when the compression cylinder is separated from the second contact piece, at the latest, the first field electrode can be brought into the electrically most advantageous position in the area of the second contact piece.

In the switched-on position, the first field electrode can then be moved axially to make space for the compression cylinder. Thus, in the switched-off state, an optimum dielectric strength of the gap is obtained, without hindering the motion of the compression cylinder.

The spring load represents the drive for the field electrode. During the switching-off process the field electrode follows the compression cylinder when the latter is withdrawn until the field electrode reaches the stop limiting its motion and determining its end position.

When the switch is switched on, the compression cylinder is pushed forward. The compression cylinder pushes back the first field electrode against the spring force until the end position of the compression cylinder is reached.

The compression piston (configured as a second field electrode) surrounds the first contact piece, so that in the switched-off state each of the contact pieces is surrounded by a field electrode. Thus a symmetrical configuration of the electric field is obtained in relation to the gap, which increases the dielectric strength of the gap.

Another advantageous embodiment of the present invention provides that the axial projections of the front surfaces of the first field electrode and of the compression cylinder at least partially overlap.

The first field electrode and the compression cylinder can, for example, have the same or similar outer diameters, so that the entire power breaker unit can be arranged in a compact manner in relation to its diameter.

The inner diameter of the field electrode can be selected, for example, so that it is slightly larger than the outer diameter of the second contact piece, so that the second contact piece represents a guide for the axial motion of the first field electrode at the same time.

The first field electrode can also be advantageously connected to a telescoping rod, which serves as a spring guide for a compression spring causing the first field electrode to move axially. This is an especially simple design for providing spring loading of the field electrode in the direction of the gap.

DETAILED DESCRIPTION

Figure 1:
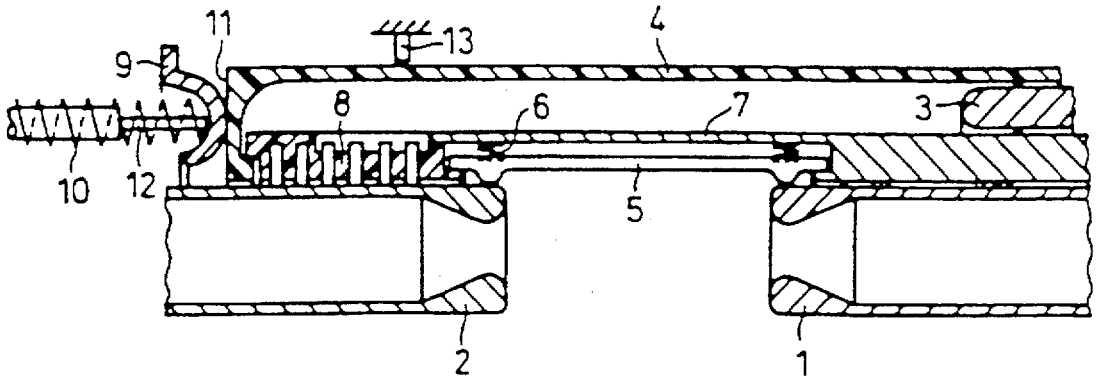
FIG. 1 shows the power switch according to the present invention in a switch-on state.
Figure 2:
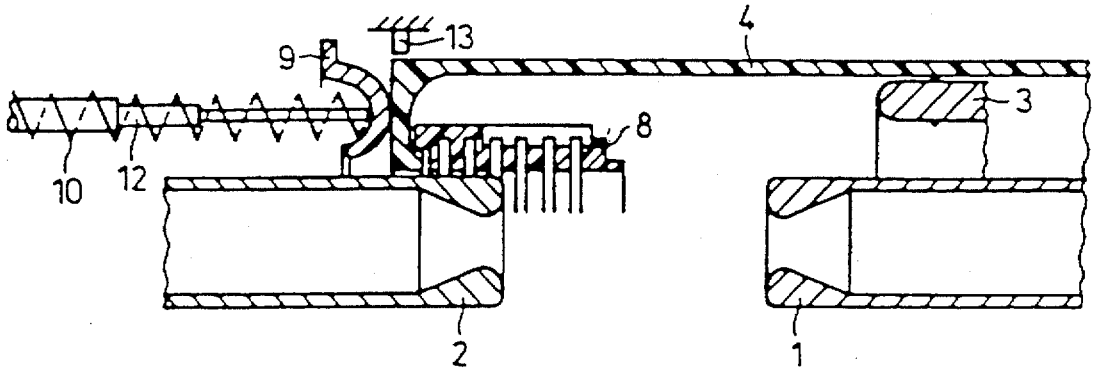
FIG. 2 shows the power switch illustrated in FIG. 1 during a switching-off motion.
Figure 3:
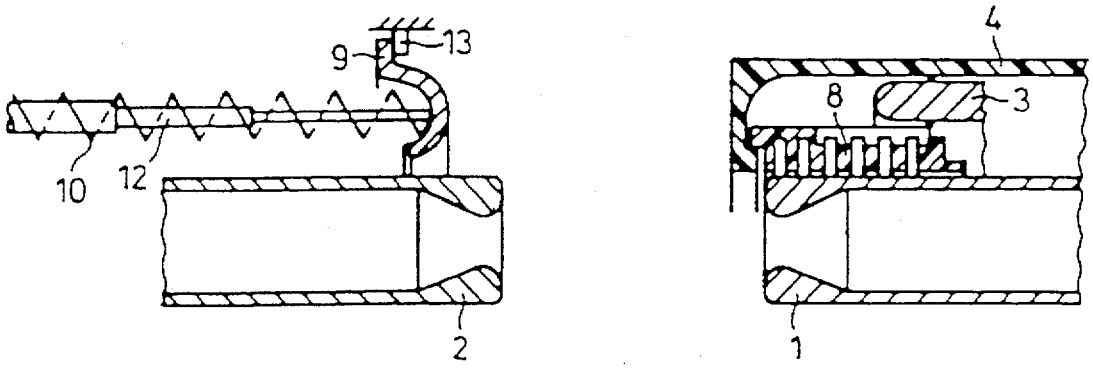
FIG. 3 shows the power switch illustrated in FIGS. 1 and 2 in the switch-off position.

The power switch according to the present invention is illustrated in the FIGS. 1–3, showing the first contact piece 1, the second contact piece 2, as well a compression piston 3 and a compression cylinder 4, driven by a drive means (not illustrated). All illustrated components of the power switch are rotationally symmetrical in relation to the central axis of contact pieces 1 and 2. For simplicity's sake, only the upper half of the device is shown.

In the switched-on state, compression cylinder 4 bridges the gap between contact pieces 1 and 2. A bridge contact 5, consisting of individual contact plates arranged peripherally in relation to a cylinder, is firmly connected to compression cylinder 4. The contact plates are supported radially outward against a support tube 7 through springs 6.

Both the bridging contact 5 and the support tube 7 of compression cylinder 4 and turbulence grid 8 are moved to the right during the switching-off process illustrated in FIG.

1. At this time, bridging contact 5 moves away from second contact 2, and interrupts the electric contact between the first contact 1 and the second contact 2.

As compression cylinder 4 moves to the right, first field electrode 9 is pressed against front face 11 of compression cylinder 4 by the force of spring 10, and follows compression cylinder 4 for a certain distance. During this motion, a telescoping rod 12, connected to the first field electrode 9 and serving as a guide for spring 10, extends.

FIG. 2 shows compression cylinder 4 in an intermediate position, where bridging contact 5 has already left second contact 2. Bridging contact 5, support tube 7 and springs 6 are not shown in FIGS. 2 and 3 for the sake of clarity.

FIG. 3 shows the switched-off state, where compression cylinder 4 is withdrawn far out of the gap between first contact 1 and second contact 2. The volume between compression piston (configured as a second field electrode) 3 and compression cylinder 4 has diminished during the switching-off process so that the compressed extinguishing gas was pressed out of this volume through turbulence grid 8 into the space between first contact 1 and second contact 2 to extinguish an arc there. Compression cylinder 4 consists of an insulating material, so that it only affects the dielectric strength of the gap slightly. Compression piston 3, consisting of a conducting material, acts as a field electrode and makes the field around first contact 1 uniform.

First field electrode 9 follows compression cylinder 4 during the switching-off process, until stop 13 limits the motion of field electrode 9 and determines its position in the switched-off state. In this position, first field electrode 9 makes the electric field in the area of second contact 2 uniform.

The arrangement consisting of contacts 1 and 2, and the two field electrodes 3 and 9, results in a uniform electric field between the contacts and thus in a higher dielectric strength of the gap.

Stop 13 can also be integrated into telescopic rod 12, for example.

What is claimed is:

1. A high-voltage power switch, comprising:

a first contact and a second contact with a gap therebetween;

a movable compression cylinder surrounding the second contact in a switched-on state, the movable compression cylinder being positioned at a predefined distance from the second contact in the switched-off state;

a first field electrode surrounding the second contact and being axially movable relative to the second contact, the first field electrode being insulated from the movable compression cylinder and being axially movable relative to the movable compression cylinder, the first field electrode being axially spring-loaded toward the compression cylinder;

a compression piston configured as a second field electrode, the second field electrode coupled to the movable compression cylinder and surrounding the first contact, the second field electrode moving in conjunction with the movable compression cylinder; and a stop member limiting a movement of the first field electrode toward the gap, wherein the movable compression cylinder and the second field electrode are drivable toward the second contact.

2. The high-voltage power switch according to claim 1, wherein the first field electrode includes a first front surface, wherein the movable compression cylinder includes a second front surface, and wherein the first and second surfaces overlap.

3. The high-voltage power switch according to claim 1, further comprising:

a compression spring; and a telescoping rod connected to the first field electrode, the telescoping rod guiding an axial movement of the compression spring, which spring biases the first field electrode toward the movable compression cylinder.

* * * * *